United States Patent [19]

Miyamoto et al.

[11] Patent Number: 4,539,808

[45] Date of Patent: Sep. 10, 1985

[54] FIBER CONTROL APPARATUS IN AN OPEN-END SPINNING FRAME

[75] Inventors: Noriaki Miyamoto, Toyota; Masanobu Shibuya, Kariya; Masashi Kaneko, Tokai, all of Japan

[73] Assignee: Kabushiki Kaisha Toyoda Jidoshokki Seisakusho, Kariya, Japan

[21] Appl. No.: 476,255

[22] Filed: Mar. 17, 1983

[30] Foreign Application Priority Data

Mar. 20, 1982 [JP] Japan ..... 57-44805

[51] Int. Cl.[3] ..... D01H 7/882; D01H 7/898

[52] U.S. Cl. ..... 57/411; 57/415

[58] Field of Search ..... 57/408, 411, 414, 415, 57/302

[56] References Cited

U.S. PATENT DOCUMENTS

| | | | |
|---|---|---|---|
| 3,511,044 | 5/1970 | Stary | 57/411 |
| 3,557,543 | 1/1971 | Krause | 57/411 |
| 3,604,194 | 9/1971 | Edagawa et al. | 57/411 |
| 3,837,153 | 9/1974 | Didek et al. | 57/415 X |
| 3,845,612 | 11/1974 | Chisholm et al. | 57/415 X |
| 4,008,561 | 2/1977 | Grau | 57/302 |
| 4,211,063 | 7/1980 | Bock et al. | 57/302 |

*Primary Examiner*—John Petrakes

*Attorney, Agent, or Firm*—Brooks Haidt Haffner & Delahunty

[57] ABSTRACT

A fiber control apparatus in an open-end spinning frame is disclosed. According to the invention, in an open-end spinning unit having a fiber passage through which fibers opened by the combing roller are carried into the spinning chamber of the rotor, one or more nozzles are provided in the unit, each nozzle having an outlet opening located adjacent to the fiber outlet opening of the fiber passage so that one or more streams of jet air, emitted from the nozzle or nozzles, direct and guide the fibers introduced into the chamber toward the interior peripheral surface of the spinning chamber of the rotor, thus causing the fibers to reach said surface immediately without being slowed or bent by ambient air streams within the chamber. Consequently, formation of yarn having bent or randomly attached fibers is substantially prevented, whereby the strength and quality of the spun yarn is greatly improved.

12 Claims, 10 Drawing Figures

FIBER CONTROL APPARATUS IN AN OPEN-END SPINNING FRAME

FIELD OF THE INVENTION

The present invention relates to an open-end spinning frame. More specifically, it relates to a fiber control apparatus in an open-end spinning frame.

BACKGROUND OF THE INVENTION

In a conventional spinning unit designated generally by a reference numeral 1 (FIG. 1), sliver 3 or a bundle of fibers is supplied through the sliver feeding inlet 2 and transferred by the feed roller 4 operating cooperatively with its presser 5 toward the combing region, where it is subjected to combing action by the combing roller 6 and, simultaneously, foreign matter or impurities 7 contained therein, such as fragments of leaves or seeds, are removed therefrom. Such foreign matter is discharged through the trash outlet 0. The fibers which have been thus opened or separated into individual fibers by the combing roller 6 are then carried by an air stream 12 into a cavity, formed in the rotor 9, which defines the spinning chamber 10 of the rotor. The flow of air 12 is developed in the fiber passage 11 due to the vacuum created upon high speed rotation of the spinning chamber 10. Such high speed rotation also creates a rotary airstream within the chamber 10 to which the introduced fibers are subjected. The fibers are thus carried outwardly into contact with the interior peripheral sidewall surface 9*a* of the chamber, and forced by centrifugal action to slide downwardly on the peripheral surface 9*a* to the fiber-collecting groove 13 which is formed at the maximum-diameter region within the spinning chamber 10. They are deposited in the form of a ribbon within the groove 13 and are subsequently withdrawn as a strand of twisted, elongated yarn through the yarn exit hole 14.

In the above-described process of open-end rotor spinning, there are two known methods of creating vacuum in the spinning chamber 10. One is a so-called forced-exhaust method, according to which air in the spinning chamber 10 is drawn off in a positive manner using a suction device (not shown) connected to an exhaust port 16 formed in the rotor casing 15 which encloses the spinning rotor 9. The other is a self-exhaust method in which a plurality of exhaust vents 17 are formed at the bottom 9*a* of the rotor, each extending in an outward radial direction of the rotor to provide air vent communication between the spinning chamber 10 and the exterior or the spinning unit 1. Air within the spinning chamber 10 is automatically drawn off through these exhaust vents 17 by the centrifugal force developed in response to the high speed rotation of the rotor 9, thereby creating vacuum in the chamber 10. In either of these methods, it is necessary that the fibers which are carried into the spinning chamber 10 from the fiber passage must reach the interior peripheral surface 9*a* of the rotor as rapidly as they possibly can. In the conventional open-end spinning apparatus, however, some of the fibers introduced into the spinning chamber 10 with the air stream 12 are not picked up immediately by the whirling air within the spinning chamber 10 which is intended to carry all of the fibers onto the interior peripheral surface 9*a*. Instead, some of such fibers are deposited in the fiber-collecting groove 13 in a bent or broken form, while the other fibers remain floating in a free state within the spinning chamber 10. As a result, bent fibers will inevitably be included in the spun yarn, thereby reducing the strength of the yarn product, and the fibers which are floating in the chamber 10 are caught by the spun yarn as it is being withdrawn toward the yarn exit 14, thereby also adversely affecting the quality of the resulting yarn.

In open-end spinning, particularly when the self-exhaust method is used, the static pressure within the spinning chamber 10 is lower in the vicinity of the axis of rotation of the rotor 9 and is higher near the interior peripheral surface 9*a* thereof, as indicated by the diagram of FIG. 2. Accordingly, the fibers introduced into the spinning chamber 10 from the fiber passage 11 have a tendency to be drawn toward the exhaust vents 17 around which the static pressure is relatively low, and it is more difficult for the fibers to be forced by centrifugal action against the interior peripheral surface 9*a* of the rotor 9, as intended.

It is known that if the length of each such exhaust vent 17 is made shorter, the rate at which air in the spinning chamber 10 is discharged through the vents 17, i.e. the volume of air being discharged therethrough, will be reduced accordingly. (For this phenomenon, refer to page 408 of "Collection of Textile Date", published by the Japanese spinners' Association, Oct. 1, 1971). For this reason, conventional spinning rotors 8 are designed having their exhaust vent openings on the rotor bottom 9*a* located inwardly or closer to the rotational axis of the rotor 9 with a view to maintaining the desired flowrate of air to be discharged through the exhaust vents 17.

Regarding variations in the speed of the whirling stream of air within the spinning chamber 10, it has been believed heretofore that, because of its viscosity, its speed is increased progressively, but non-linearly toward the interior peripheral surface 9*a*, as shown by the phantom curved line in the diagram of FIG. 3. In FIG. 3, the straight line shows the linear increase in speed of the rotary air stream which accompanies an increase in the speed of the rotor 9.

However, results of tests using a Pitot static tube have revealed that, in the spinning chamber 10, although one rotating air stream having considerably high speed is created along the boundary region in close proximity to the fast-moving internal peripheral surface 9*a*, at other locations within the chamber there exists only the slower rotating air stream that is formed by the flow of air into the exhaust vents 17. These results are represented by the solid line in the diagram of FIG. 3. Where the openings of the exhaust vents 17 on the bottom 9*b* are located closer to the rotational center of the rotor 9 for the reason previously mentioned, the resulting rotary stream will be produced in the vicinity of the center of the rotor 9. Therefore, between the rotary air stream produced by the flow of air into the exhaust vents 17 and the high speed rotary air stream created in close proximity to the interior peripheral surface 9*a*, there also exists an accompanying, rather large region within which the speed of the rotating air stream is even lower, as indicated by the trough portion of the solid line in the diagram of FIG. 3.

Thus, using a spinning rotor 9 having a self-exhaust system, the fibers carried from the fiber passage 11 into the spinning chamber 10 are caused to reduce their speed as they move to the region within the spinning chamber 10 which corresponds to the above-mentioned trough portion of the graph, in which region the speed of the rotary stream is reduced. Consequently, the numbers of those fibers which are collected in the fiber-collecting groove 13 in a bent form, and which remain floating within the spinning chamber without reaching the fiber-collecting groove, are increased. As a result, the fibers which constitute the spun yarn will include such bent fibers, thus reducing the strength of the yarn, or will catch the floating fibers while being withdrawn from the fiber-collecting groove 13, thereby degrading the quality of the resulting yarn.

SUMMARY OF THE INVENTION

It is an object of the invention to remove the above-stated disadvantages and drawbacks of the prior art.

It is also an object of the invention to provide a fiber control apparatus in an open-end spinning frame by which the fibers carried from the fiber passage into the spinning chamber can be brought immediately, and without reduction in speed, to the interior peripheral surface of the rotor spinning chamber.

These objects of the invention can be accomplished by providing a nozzle adjacent to the outlet of the fiber passage for emitting a flow of compressed air which is directed so as to guide the fibers, which are being moved through said outlet, toward the interior peripheral surface of the rotor spinning chamber.

The above and other objects, features and advantages of the present invention will become apparent to those skilled in the art from the following description of preferred embodiments of the invention, taken in conjunction with the drawings, wherein:

DETAILED DESCRIPTION OF EMBODIMENTS

Figure 1:
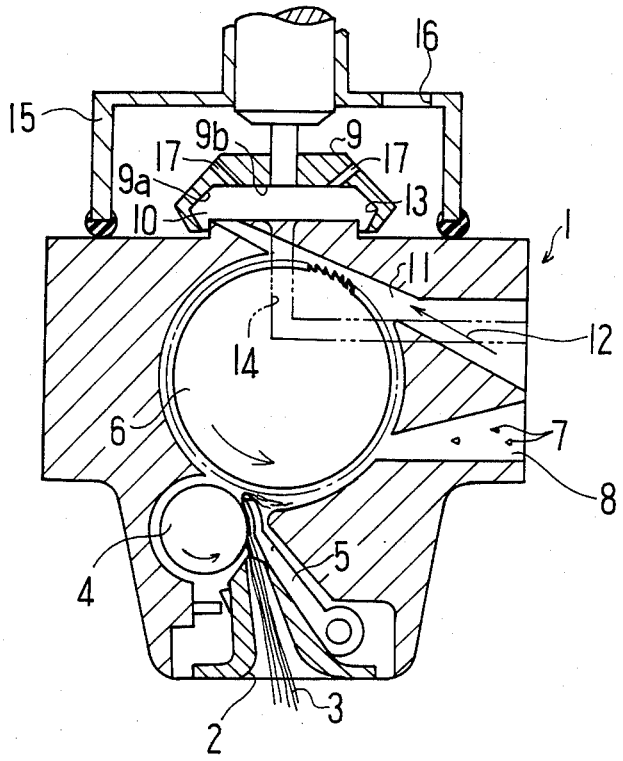
FIG. 1 PRIOR ART
FIG. 1 is a sectional view showing a conventional spinning unit in an open-end spinning frame.
Figure 2:
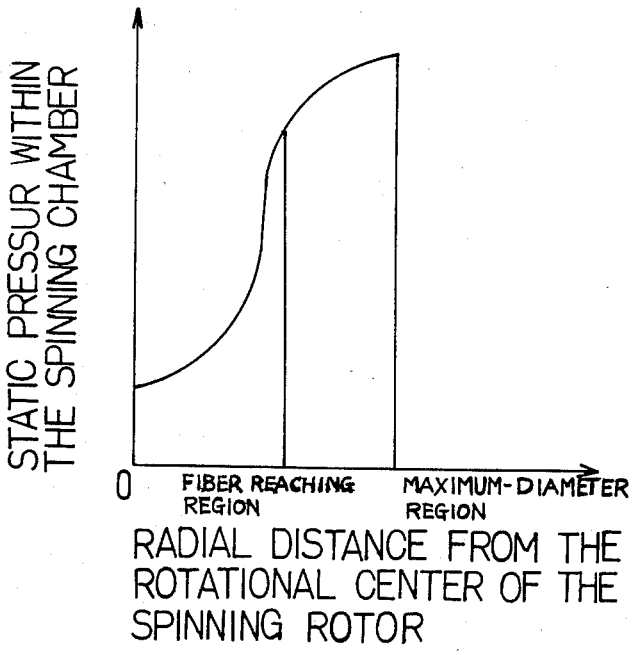
FIG. 2 is a diagram showing the distribution of static pressure within the spinning chamber of a self-exhaust type rotor.
Figure 3:
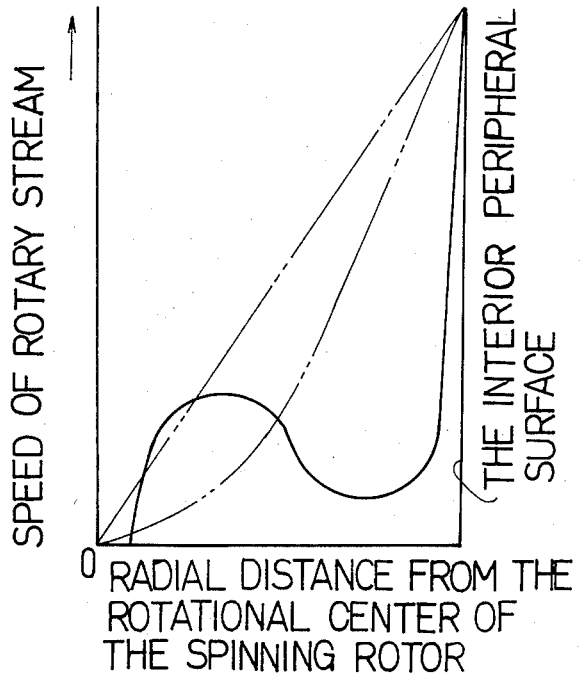
FIG. 3 is a diagram showing the distribution of speed variations of the rotating air stream taking place within the spinning chamber of a self-exhaust type rotor.

The stucture and functional effect of a preferred embodiment according to the invention will now be explained in detail with reference to FIGS. 4 and 5. Since the spinning unit of the invention differs from the conventional one described previously with reference to FIG. 1 only in several respects, those parts or members of the former which correspond to those of the latter are correspondingly indicated using the same reference numerals.

Figure 4:
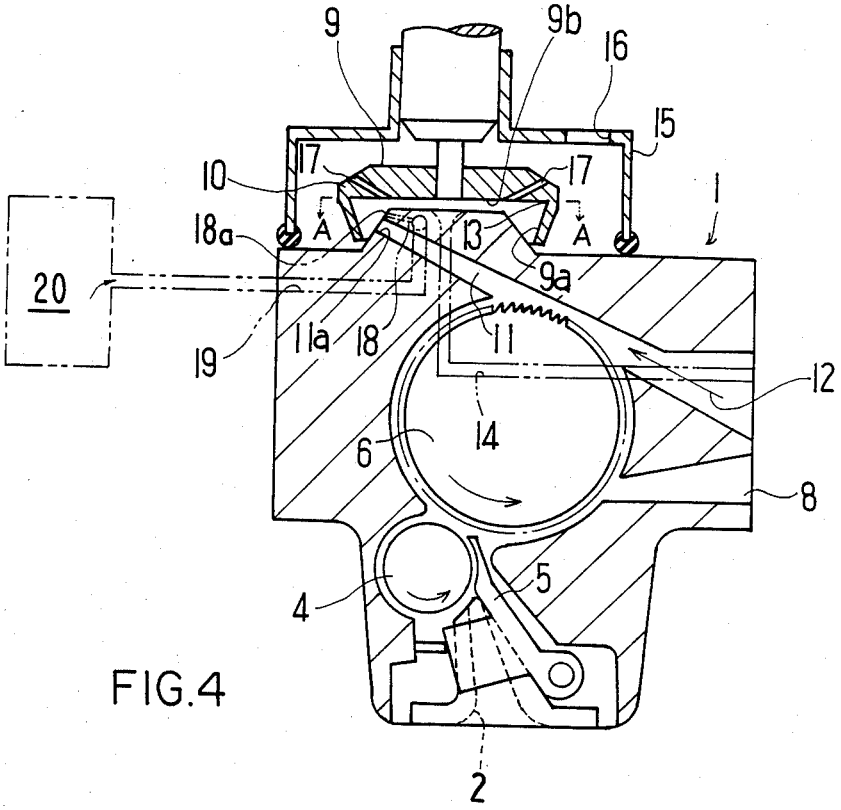
FIG. 4 is a sectional view showing a preferred embodiment of a spinning unit constructed according to the present invention.
Figure 5:
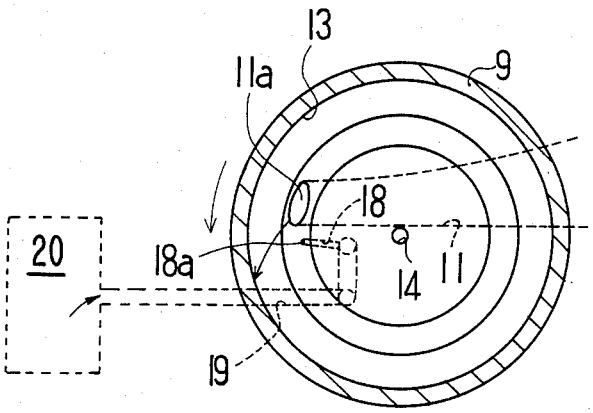
FIG. 5 is an enlarged sectional view taken along the line A—A in FIG. 4.

Referring to FIGS. 4 and 5, the fiber passage 11 is arranged such that its outlet opening 11*a* is directed towards the interior peripheral surface 9*a* of the rotor 9, as shown. Adjacent to the outlet opening 11*a* and on the downstream side thereof with respect to the rotational direction of the rotor 9, is an opening 18*a* of a nozzle 18 for injecting a stream of compressed air to guide the fibers, which are moving out of said fiber passage 11, toward the interior peripheral surface 9*a* of the rotor 9. A conduit 19 from any suitable external source of compressed air 20 supplies the compressed air to the nozzle 18.

The functional effect of the spinning unit 1 thus constructed will be described as follows: As previously stated, a rotating stream having a remarkably high speed is developed in the region in close proximity to the interior peripheral surface 9*a* in response to its high speed rotation, while another rotating stream is produced near the center of the rotor 9. Between these two rotating streams there exists a wide region within which the speed of rotation of the air stream is rather low and, therefore, the fibers introduced into the spinning chamber 10 reduce their speed as they move toward the interior peripheral surface 9*a*. However, in the spinning unit 1 having a nozzle 18 which issues a jet stream of air from its opening 18*a*, the fibers which are opened up by the combing roller 6 and then carried by the air stream 12 into the spinning rotor 10 are forced and guided toward the interior peripheral surface 9*a*, without being slowed down in the aforementioned region of low-speed rotating air, by the additional stream of compressed air from the nozzle 18. In other words, because the air stream 12 which contains the fibers and is flowing into the spinning chamber 10 is weaker than the ambient rotating stream of air which is flowing into the exhaust vents 17, the fibers which would not otherwise be brought by the air stream 12 alone to the region of the high speed whirling air stream adjacent to the interior peripheral surface 9*a* are assisted by a stream of jetted air issuing from the nozzle 18, which provides a propelling action to move the fibers through the zone of slowly rotating air, and direct them against the peripheral surface 9*a*. As a result, the fibers emanating from the fiber passage 11 reach the peripheral surface 9*a* immediately, or are picked up successfully by the rotating air stream whirling at a high speed in the vicinity thereof, and are collected in the fiber-collecting groove 13 in a straightened form.

In this way, the number of bent fibers that are included in the fibers constituting the spun yarn or are caught by the yarn as it is withdrawn from the fiber-collecting groove are greatly reduced, with the result that the strength and quality of the resulting yarn is much improved.

Figure 6:
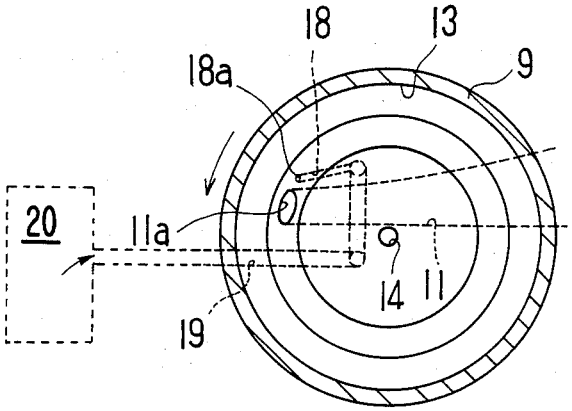
FIG. 6 is similar to FIG. 5, but showing another embodiment of the invention.

Reference is now made to FIG. 6 which illustrates another embodiment of the invention. This embodiment differs from that of FIGS. 4 and 5 in that the opening 18*a* of the nozzle 18 is located on the upstream side of the fiber outlet opening 11*a*, with respect to the direction of rotation of the rotor 9. In this embodiment, the jet stream of air from the nozzle 18 provides a blocking of the rotating air stream flowing towards the exhaust vents 17 on the upstream side of the fiber outlet opening 11*a*, so as to permit an unblocked flow of air and fibers from the opening 11*a* directed toward the interior peripheral surface 9*a* of the rotor 9. Therefore, the fibers carried into the spinning chamber 10 with the air stream 12 are carried all the way to the interior peripheral surface 9*a* without slowing on the way, which causes bending or dwelling of the fibers. Thus, this embodiment achieves substantially the same functional effect as the first embodiment.

Figure 7:
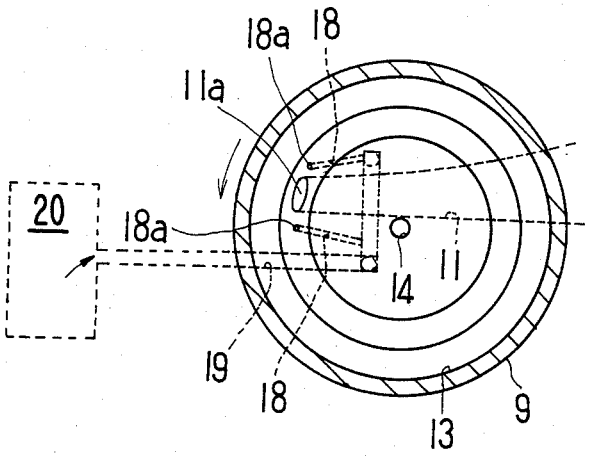
FIGS. 7 and 8 are enlarged sectional views similar to FIG. 5, but showing modified embodiments of the invention.
Figure 8:
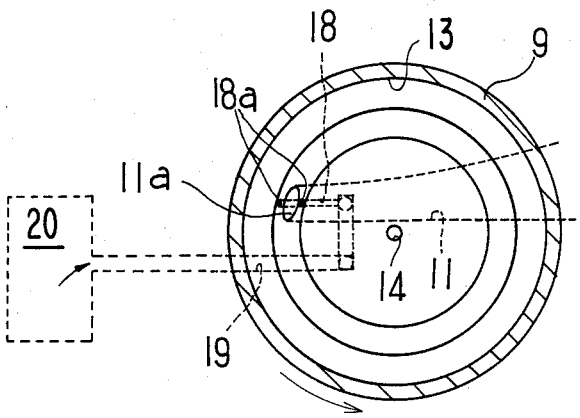
Figure 9:
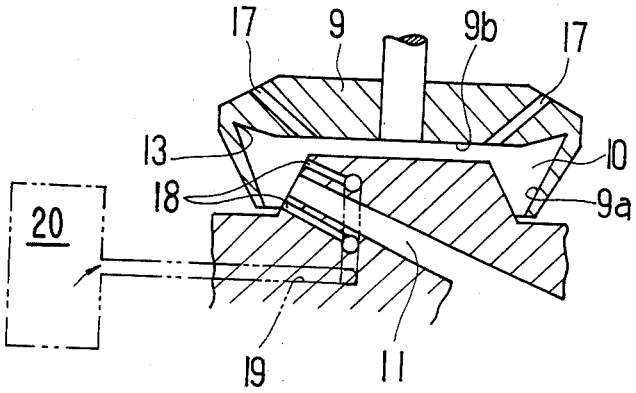
FIG. 9 is a sectional view of the embodiment of FIG. 8.
Figure 10:
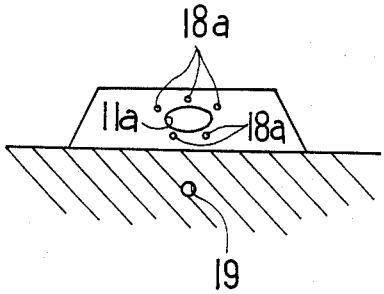
FIG. 10 is an enlarged partial showing of still another modified embodiment of the invention.

The present invention is not limited to the illustrated embodiments of FIGS. 4–5 and 6, but may be embodied in other forms such as those exemplified in FIGS. 7 through 10. In FIG. 7, two nozzles 18 are provided with their openings 18*a* located adjacent to, and on both the upstream and downstream sides of the fiber outlet opening 11*a*. In FIGS. 8 and 9, the openings 18*a* of two nozzles 18 are respectively located above and below the fiber outlet opening 11*a*, and in FIG. 10, any desired number of the nozzle openings 18*a* are provided, surrounding the fiber outlet opening 11*a* substantially at equal intervals.

Furthermore, it is to be understood that this invention is applicable not only to spinning units of the self-exhaust type, but also to those which operate on forced-exhaust system principles.

From the foregoing description, it should now be apparent to those skilled in the art that by providing one or more nozzles 18 whose respective openings 18*a* are located adjacent to the fiber outlet opening 11*a* of the fiber passage 11 through which fibers separated by the combing roller 6 are carried into the spinning chamber 10, for jetting one or more streams of compressed air directed toward the interior peripheral surface 9*a* of the rotor 9, the fibers are guided directly to, and are deposited in the fiber-collecting groove in a straightened form, and the number of such fibers that dwell in the spinning chamber 10 in a floating state can be greatly reduced. In this way, harmful bent fibers, and randomly attached fibers in the spun yarn are avoided, and the strength and quality of the resulting spun yarn is improved.

What is claimed is:

1. In an open-end spinning apparatus comprising a spinning rotor mounted for rotation and having an interior peripheral surface and a bottom surface which surfaces together define a spinning chamber of the rotor, and a fiber passage having a fiber outlet opening through which a stream of opened fibers are carried into said spinning chamber of the rotor and directed towards said interior peripheral surface, the improvement comprising means defining at least one nozzle having a nozzle opening located substantially adjacent to and separate from said fiber outlet opening, and means for emitting a continuous jet stream of compressed air from said nozzle opening towards and against said interior peripheral surface of the spinning rotor during the spinning operation, whereby said stream of opened fibers is guided to said interior peripheral surface by said jet stream of compressed air.

2. The improvement according to claim 1, wherein said nozzle opening is located on the downstream side of said fiber outlet opening with respect to the direction of rotation of said rotor.

3. The improvement according to claim 1, wherein said nozzle opening is located on the upstream side of said fiber outlet opening with respect to the direction of rotation of said rotor.

4. The improvement according to claim 1, wherein a plurality of said nozzle openings are provided substantially adjacent to said fiber outlet opening.

5. The improvement according to claim 4, wherein said plurality of nozzle openings comprise a pair of hozzle openings respectively located above and below said fiber outlet opening.

6. The improvement according to claim 4, wherein said plurality of nozzle openings are in substantially equally spaced apart relation with respect to each other, and substantially surround said fiber outlet opening.

7. The improvement according to claim 1, wherein said open-end spinning apparatus further comprises a self-exhaust system for said spinning chamber.

8. The improvement according to claim 1, wherein said open-end spinning apparatus further comprises a forced-exhaust system for said spinning chamber.

9. A method of guiding opened fibers in their passage from the fiber passage outlet opening in an open-end spinning frame to deposit upon the interior peripheral sidewall surface within the spinning chamber of a spinning rotor during normal high speed operation of the rotor, comprising establishing a vacuum within said spinning chamber to draw said fibers into said chamber in a stream emanating from said fiber passage outlet opening, and introducing a continuously flowing jet of compressed air into said spinning chamber adjacent to said stream of fibers and directed towards and against said interior peripheral sidewall surface to guide said fibers across ambient air streams to deposit upon said peripheral sidewall surface.

10. A method according to claim 9, wherein said jet of compressed air is introduced from a location on the downstream side of said fiber passage outlet opening with respect to the direction of rotation of said spinning rotor.

11. A method according to claim 9, wherein said jet of compressed air is introduced from a location on the upstream side of said fiber passage outlet opening with respect to the direction of rotation of said spinning rotor.

12. A method according to claim 9, wherein a plurality of said continuously flowing jets of compressed air are introduced into said spinning chamber from respective locations adjacent to, and on opposite sides of said fiber passage outlet opening.

* * * * *